US011597569B2

(12) United States Patent
Neiner

(10) Patent No.: US 11,597,569 B2
(45) Date of Patent: Mar. 7, 2023

(54) CAN COMPRISING A FIRST, DISPENSE OPENING AND SECOND, VENT OPENING AND A SINGLE PULL TAB

(71) Applicant: Anheuser-Busch InBev S.A., Brussels (BE)

(72) Inventor: Christopher Neiner, Newtown, PA (US)

(73) Assignee: ANHEUSER-BUSCH INBEV S.A., Brussels (BE)

( * ) Notice: Subject to any disclaimer, the term of this patent is extended or adjusted under 35 U.S.C. 154(b) by 0 days.

(21) Appl. No.: 16/847,593

(22) Filed: Apr. 13, 2020

(65) Prior Publication Data

US 2020/0239204 A1 Jul. 30, 2020

Related U.S. Application Data

(62) Division of application No. 15/954,531, filed on Apr. 16, 2018, now Pat. No. 10,618,708, which is a (Continued)

(30) Foreign Application Priority Data

Jan. 3, 2012 (EP) ..... 12150045

(51) Int. Cl.
*B65D 51/16* (2006.01)
*B65D 17/28* (2006.01)

(52) U.S. Cl.
CPC ..... *B65D 51/1683* (2013.01); *B65D 17/4012* (2018.01); *B65D 2517/0014* (2013.01); *B65D 2517/0092* (2013.01)

(58) Field of Classification Search
CPC ..... B65D 51/1683; B65D 17/4012; B65D 2517/0014; B65D 2517/0092; B65D 17/401

(Continued)

(56) References Cited

U.S. PATENT DOCUMENTS 3,272,166 A 9/1966 Henchert
3,307,737 A 3/1967 Harvey et al.
(Continued)

FOREIGN PATENT DOCUMENTS

CA 2 280 461 11/2001
CN 1668505 A 9/2005
(Continued)

OTHER PUBLICATIONS

Patent Office of the Russian Federation, "Decision To Grant a Patent for an Invention" dated Sep. 15, 2016, 2 pages.
(Continued)

*Primary Examiner* — James N Smalley
(74) *Attorney, Agent, or Firm* — Klintworth & Rozenblat IP LLP

(57) ABSTRACT

A can for containing a liquid has a top end having a dispense area defined by a first score line and a pull tab coupled to the top end by a rivet. The pull tab has a puncturing end for breaking the first score line and pushing into the interior of the can without detaching the dispense area to open a dispense aperture. A vent area is defined by a second score line and positioned on the opposite side of the rivet. The first and second score lines are separated by at least one torsion stripe of the can top material for acting as a hinge by torsion upon lifting the actuating end of the pull tab. As the dispense aperture is opened by pushing the dispense area into the interior of the can, a vent aperture is opened by pulling the vent area outwards.

15 Claims, 2 Drawing Sheets

Related U.S. Application Data division of application No. 14/370,756, filed as application No. PCT/EP2012/076822 on Dec. 21, 2012, now Pat. No. 9,944,441.

(58) Field of Classification Search
USPC ..... 220/269–271, 906
See application file for complete search history.

(56) References Cited

U.S. PATENT DOCUMENTS

| | | | |
|---|---|---|---|
| 3,326,406 | A | 6/1967 | Brown |
| 3,604,589 | A | 9/1971 | Fraze |
| 3,618,815 | A | 11/1971 | Heffner |
| 3,744,666 | A | 7/1973 | Heffner |
| 3,796,344 | A | 3/1974 | De Phillips et al. |
| 3,856,184 | A | 12/1974 | Luviano |
| 3,868,918 | A | 3/1975 | Smith, Jr. et al. |
| 4,014,455 | A | 3/1977 | LaCroce |
| 4,213,538 | A | 7/1980 | Boardman |
| 4,411,370 | A | 10/1983 | Rausing |
| 5,397,014 | A | 3/1995 | Aydt |
| 5,494,184 | A | 2/1996 | Noguchi et al. |
| 5,695,085 | A | 12/1997 | Hadener |
| 5,819,973 | A | 10/1998 | Traub, Sr. et al. |
| 7,513,383 | B2 | 4/2009 | Hwang |
| 2003/0098306 | A1 | 5/2003 | Cho |
| 2003/0111469 | A1 | 6/2003 | Hartman et al. |
| 2008/0067175 | A1 | 1/2008 | Junkel et al. |
| 2010/0018976 | A1 | 1/2010 | Christian et al. |
| 2010/0029477 | A1 | 2/2010 | Mclaughlin et al. |
| 2011/0056946 | A1 | 3/2011 | Emanuelle, III et al. |

FOREIGN PATENT DOCUMENTS

| | | | |
|---|---|---|---|
| CN | 102202981 | A | 9/2011 |
| JP | 05-310248 | | 11/1993 |
| NL | 1023297 | | 11/2004 |
| SU | 1491328 | A3 | 6/1989 |
| WO | WO 2004/035399 | | 4/2004 |
| WO | WO 2008/023983 | | 2/2008 |
| WO | WO 2008/034801 | | 3/2008 |
| WO | WO 2009/078738 | | 6/2009 |
| WO | WO 2010/046516 | | 4/2010 |

OTHER PUBLICATIONS

The State Intellectual Property Office of the People's Republic of China, "Notice on the First Office Action" dated May 25, 2015, 14 pages.

CAN COMPRISING A FIRST, DISPENSE OPENING AND SECOND, VENT OPENING AND A SINGLE PULL TAB

TECHNICAL FIELD

The present invention relates to the field of cans for containing a liquid. In particular, it concerns beverage cans, such as beer, soda, tonic and the like, comprising a first dispensing aperture and a second vent aperture, wherein both apertures can be opened in a single movement.

BACKGROUND FOR THE INVENTION

Beverage cans have been on the market for several decades, undergoing a series of evolutions, such as the progressive passage from a "detachable pull tab," wherein a closed loop scored section is coupled to a ring tab, to a "push-in tab" type, wherein no element is detached from the can upon opening. Since in both instances an actuating end of a tab must be pulled off the plane formed by the can top end to open a dispense area, such tabs are herein referred to indiscriminately as "pull tabs".

Rapidly, it appeared that cans comprising a single, dispense aperture leads to gurgling of the beverage, due to the difficulty for such systems to balance the pressures inside and outside the can upon dispensing. It has been found that providing the can top with a second, vent aperture, spaced apart from the dispense aperture, yielded a much smoother flow of the liquid out of the can, since the pressure inside the can could instantly adapt to the ambient pressure through said vent aperture. Many two-opening can systems were proposed in the art with widely differing opening mechanisms.

U.S. Pat. No. 4,213,538 proposes a can having a can top provided with two score lines forming closed loops defining two areas to be pushed in with a finger or an external tool. An alternative solution is to fix a pull tab to a rivet located between two areas defined by score lines, such that the tab can be tilted both ways to push a first and then a second areas inside the can like a seesaw such as disclosed in U.S. Pat. No. 5,695,085 or 5,397,014. In some cases, a single pull tab is first pulled up to push in the dispensing area and then pushed back to its initial position and further down to press in the vent area, such as in US2010/0018976, US2011/0056946, WO2009/078738. These systems, however, have the problem that the vent can be accidentally opened in case a pressure is applied onto the tab. To solve this problem, it has been proposed to not align the first and second apertures with the rivet coupling the tab to the can top. This way, after opening the dispensing opening the pull tab must be swiveled about the rivet axis by the corresponding offsetting angle to face the vent area and only then pushed down to press the vent area Inside the can such as disclosed in WO2008/023983. In an alternative embodiment, the actuating end of a tab is first pulled up to open the dispense aperture, then swiveled 180° to face the diametrically opposed vent area, the actuating end is pulled up again to open the vent aperture the same way the dispensing aperture was opened, as in U.S. Pat. No. 5,494,184. WO2010/046516 discloses a can comprising a main pull tab and a secondary lever, both fixed to the can top by a single rivet, wherein the secondary lever is brought into puncturing position upon lifting the main pull tab to puncture the dispense area, whereafter the main tab is brought back to its original position, with the secondary lever brought into puncturing position in front of the vent area, which is opened by pressing further down the main pull tab. This system allows to prevent any accidental opening of the vent. All these systems have in common that several movements are required to open both dispense and vent openings, which is rather inconvenient, in particular when the user has only one hand free to open a can.

Solutions for opening both dispense and vent apertures in a single movement have been proposed in the art. U.S. Pat. No. 3,307,737 discloses a single pull tab coupled to a dispense and a vent areas each forming a closed loop. By pulling one free end of the pull tab, the vent is first pulled off the top can, followed by the dispense area. The inconvenient of this rather old system is well known, in that it generates waste which generally ends on the ground and represents both an ecological threat and a source of injuries. CA2280461 proposes to couple with a rivet the ring end of a pull tab to a vent score line forming a closed loop. By pulling up said ring end to puncture the dispense area, the vent area is pulled off the can top. This system has the inconvenient that a strong force is needed to pull off the vent area from the can top with no leverage offered by said design. US2003/0098306 proposes an improvement to the foregoing system by providing a second lever hinged to the main pull tab at the level of the rivet of the vent area, so that the main pull tab is pulled by pulling the second lever, thus yielding a higher couple. WO2004/035399 and U.S. Pat. No. 3,326,406 disclose systems wherein a single pull tab is coupled to the can top with a first rivet and to a vent area with a second rivet. Unlike the preceding systems, here both dispense and vent areas are pushed into the can by pulling up the pull tab at a point forming a triangle with the first and second rivets forming acute angles. The leverage is provided by the altitude of the triangle intersecting the line between the two rivets.

The present invention provides yet an alternative solution for opening simultaneously a dispensing and vent apertures with a single movement of the hand.

SUMMARY OF THE INVENTION

The present invention is defined in the appended independent claims. Preferred embodiments are defined in the dependent claims. In particular, the present invention concerns a can for containing a liquid and comprising a top end, said top end comprising:

(a) A dispense area defined on said top end by a first score line, (b) A pull tab coupled to the top end by a rivet, said pull tab comprising a puncturing end suitable for breaking the first score line and pushing into the interior of the can without detaching the dispense area to open a dispense aperture upon lifting an opposite actuating end of said pull tab away from the top end, (c) A vent area defined on said top end by a second score line separate from the first score line and positioned on the opposite side of the rivet as the first dispense area, Characterized in that, the first and second score lines are separated from one another by at least one torsion stripe of the can top material suitable for acting as a hinge by torsion upon lifting the actuating end of the pull tab away from the can top, such that as the dispense aperture is being opened by pushing the dispense area into the interior of the can, a vent aperture is opened by pulling the vent area outwards from the can top end.

In order to promote the bending of the torsion stripe upon lifting the actuating end of the pull tab, said torsion stripe may comprise secondary score lines which are much shallower than the first and second score lines such that they would not break but bend. The secondary score lines may be discontinuous. In an alternative embodiment, the torsion stripe comprises no score line.

Upon opening the dispense and vent apertures, it is highly desired that the corresponding dispense and vent areas remain attached to the can top end, to avoid littering with small pieces of metal. This can be achieved by forming the first and/or second score lines into an open loop. Upon lifting the actuating end of the pull tab, the dispense area and/or vent area would thus be bent about a line defined between the two open ends of the respective score lines. In an alternative embodiment, the first and/or second score lines form a closed loop, but a section of said closed loop has a much shallower score than the rest of the score line. The bending line of the dispense area and/or vent area would thus be defined by the shallow score line section.

In one preferred embodiment, the first and second score lines are substantially in the shape of two Ω's facing each other by their open sides, separated by a torsion stripe comprising the rivet. In this configuration, the torsion stripe is therefore defined by the area separating the substantially straight legs of the opposed Ω's. The curved portion of the Ω of the second score line defines the vent area and is substantially smaller than the curved portion of the Ω of the first score line which defines the dispense area.

In an alternative embodiment, the second score line is partially nested within the first score line on either side of the rivet forming two torsion stripes on either side of the rivet, where a section of the first score line overlaps a section of the second score line. The rivet may be partially circumscribed within the second score line defining the vent area.

To facilitate the breaking of the second score line to pull open the vent area, the second score line may be deeper than the first score line. To get yet a larger dispense aperture, the rivet may be offset in the direction of the vent area, with respect to the centre of the can top end, such that the vent area is brought closer to the rim of the can top end, leaving more room for the dispense area.

A can according to the present invention is particularly suitable for containing a beverage such as alcoholic or non-alcoholic beer or other fermented beverages, soda, tonic, juice, energetic beverages, soup, long drink, and the like. Such can, and in particular the top end thereof is preferably made of aluminium, an aluminium alloy or tin plated steel.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
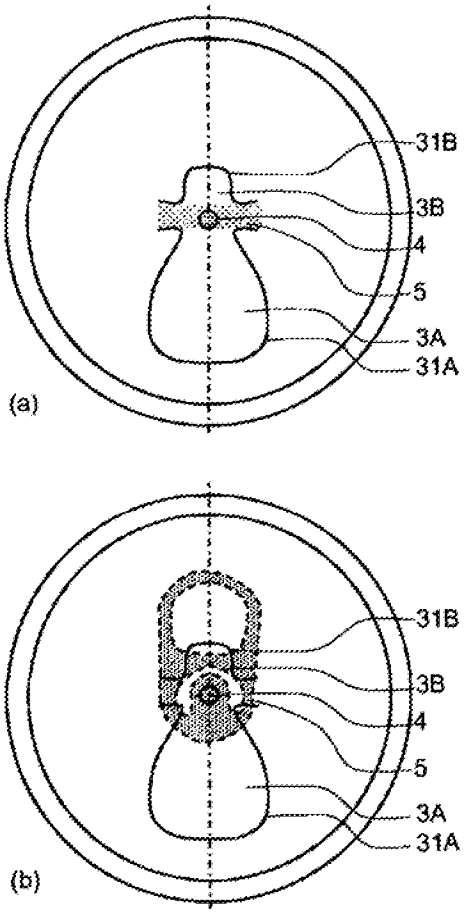
FIG. 1: shows a top view of the can top of a can according to a first embodiment of the present invention, represented (a) without and (b) with a pull tab.

As can be seen in FIGS. 1 to 4, a can according to the present invention comprises a top end like traditional cans available in shops to date, with a dispense area (3A) defined on said top end by a first score line (31A), and a pull tab (2) coupled to the top end by a rivet (4). The pull tab (2) comprises a puncturing end (21) overlapping the dispense area and an opposite actuating end (22) which, upon lifting away from the plane of the can top end presses the puncturing end (21) against the dispense area, breaking the score line and pushing the dispense area into the can, thus opening the dispense aperture (13A). It is of course much preferable that upon opening the dispense aperture (13A), neither the pull tab (2) nor the dispense area (3A) are separated from the can top end. This can be achieved either by not closing the path formed by the first score line (31A) or by providing a portion of said first line with a shallower score (i.e., less deep) than the rest of the outline. By either of these ways, upon pressing the puncturing end (21A) of the pull tab against the dispense area (3A), the latter will fold about a line between the two ends of the open loop score line, or about the shallower portion of the score line. The dispensing part of the can is quite similar to traditional cans. The gist of the present invention, however, is in the design and position of the vent area (3B) which allows, with a single pull on the actuating end of the pull tab to open a vent (13B) simultaneously with the dispense aperture (13A).

The vent area (3B) is defined by a second score line (31B), and is located on the can top end opposite the dispense area (3A) with respect to the rivet (4). The vent area (3B) should most preferably not be separated from the can top end upon opening the vent aperture. Like for the dispense area (3A) discussed supra the score line (31B) defining the vent area (3) should define an open path, or comprise a portion of shallower score, to allow outward folding of the vent area (3B) about said unscored or shallow scored line portion. It is preferred, however, that if the second score line (31B) forms a closed loop with a shallower score portion, the rivet (4) is preferably circumscribed within said second score line. Indeed, it is important that the tongue of metal extending between rivet (4) and the point of the second score line (31B) furthest away from the dispense area (3A) be sufficiently stiff so that the tilting of the rivet upon lifting the actuating end of the pull tab triggers the rupture of the score line. The vent area (3B) is generally smaller in size than the dispense area (3A), since the former needs only to ensure pressure balance during dispensing of the liquid out of the can, and a smooth depressurization upon opening of the can.

Opening of the vent aperture (13B) is possible by the torsion or bending of a torsion stripe (5) (cf. shaded areas in FIGS. 1(*a*), 2(*a*), 3(*a*), and 4(*a*)) upon lifting the actuating end (22) of the pull tab (2). The first and second score lines (31A, 31B) are separated from one another by an area of the can top material defining at least one torsion stripe (5) suitable for acting as a hinge by torsion upon lifting the actuating end (22) of the pull tab (2) away from the can top. When the actuating end (22) of the pull tab (2) is lifted, the puncturing end located opposite thereof with respect to the rivet (4) presses onto the dispense area (3A), breaking the score line (31A) and pushing the dispense area (13A) into the interior of the can. The tilting of the pull tab about the rivet creates a moment of torsion in the area of the can top end comprising the rivet, which results in a tilting of the rivet itself with respect to the plane defined by the can top end. By creating an appropriate torsion stripe (5) at or around the rivet, the moment of torsion acting in the area around the rivet can be taken advantage of to create an upward lifting force capable of breaking the second score line (31B) and to lift the vent area (3B) away from the can top end to open the vent (13B).

The dispense area (3A), the rivet (4), and the vent area (3B) are preferably aligned on a first diameter of the can top end in this order. The at least one torsion stripe (5), acting as a hinge about which the rivet (4) can tilt, may generally be substantially normal to said first diameter. Since the rivet coupling the pull tab (2) to the can top end defines an area of higher bending stiffness, pulling the actuating end (22) of the pull tab (2)—which is sandwiched between the can top end and the head of the rivet (4)—is necessarily accompanied by some tilting of the rivet and by the creation of a bending field in the can top end surrounding it. The creation of a torsion stripe (5) of lower bending stiffness increases the difference in bending stiffness between the rivet area and the area surrounding it, allowing to increase the magnitude of the bending field behind the rivet area with respect to the dispense area (3A). To further enhance the hinge effect, the torsion stripe (5) may be provided with secondary score lines, which are much shallower than the first and second score lines (31A, 31B) since they are not intended to break but only to facilitate bending of the stripe. By designing the score lines properly, however, secondary score lines are not necessary to yield the desired hinge effect.

Figure 5:
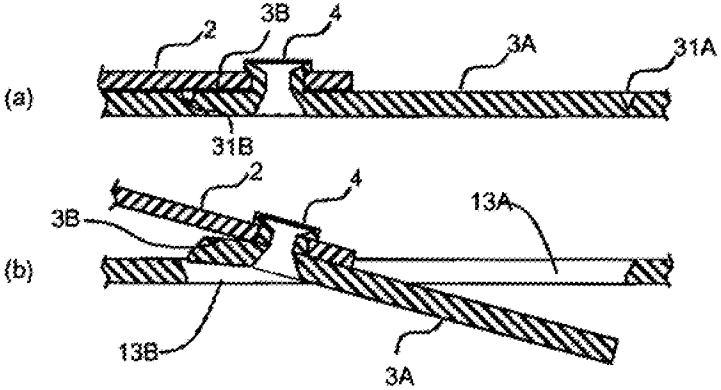
FIG. 5: shows a side cut of a can according to the present invention, (a) in a closed position, and (b) in an open position.

In a first embodiment represented in FIG. 1, the dispense and vent areas (3A, 3B) are aligned along a first diameter of the can top end on either side of the rivet (4). The first and second score lines 31A, 31B) defining them each forms a bulging open loop defining the dispensing and vent areas, respectively, with the open portion of the loops facing each other, with the rivet (4) in between. The two end sections of each of the first and second score lines face each other extending substantially normal to said first diameter thus defining a torsion stripe (S) therebetween. As can be appreciated in FIG. 1(*a*), the first and second score lines actually have a shape similar to a Ω, with their open portion facing each other, the curved portion defining the dispense and vent areas (3A, 3B) and the straight legs of each score line facing each other defining the torsion stripe (5). The curved portion of the second score line (31B) is much smaller in size than the one of the first score line (31A) which defines the dispense area, but the straight legs of both score lines are of similar length. It is clear that the end portions of the first and second score lines need not be straight, but can be slightly curved, as long as a torsion stripe is defined between the two score lines (cf. shaded area in FIG. 1(*a*)). FIG. 1(*b*) shown the same can top as in FIG. 1(*a*) provided with a pull tab represented in transparency. It can be seen from FIG. 1(*b*) that the can top of the present embodiment is very similar to a traditional single aperture can top available on the market. The use of the inventive can is also exactly similar to the one consumers are used to with traditional single aperture cans, by simply forcing one finger under the actuating end (22) of the pull tab and lifting it away from the can top. This presses the puncturing end of the pull tab onto the dispense area (3A) until the first score line (31A) breaks as is common with single aperture cans. At the same time, the rivet (4) undergoes a severe torsion stress by the lifting of the pull tab. As illustrated in FIG. 5(*b*), thanks to the weakening effect created by the torsion stripe (5) the rivet is allowed to tilt towards the dispense aperture (I 3A) about an axis substantially parallel to the torsion stripe (5), creating a stress in its wake, sufficient to break the second score line (31B) and to lift up the vent area (3B) and thus open the vent aperture (13B) in a single movement. The similarity both in appearance and in use of a can according to the present invention with traditional single aperture cans is an advantage as the consumers need not get used to a new design or to a new way of handling a can, whilst they still get the benefits of a can comprising a vent aperture (13B).

Figure 2:
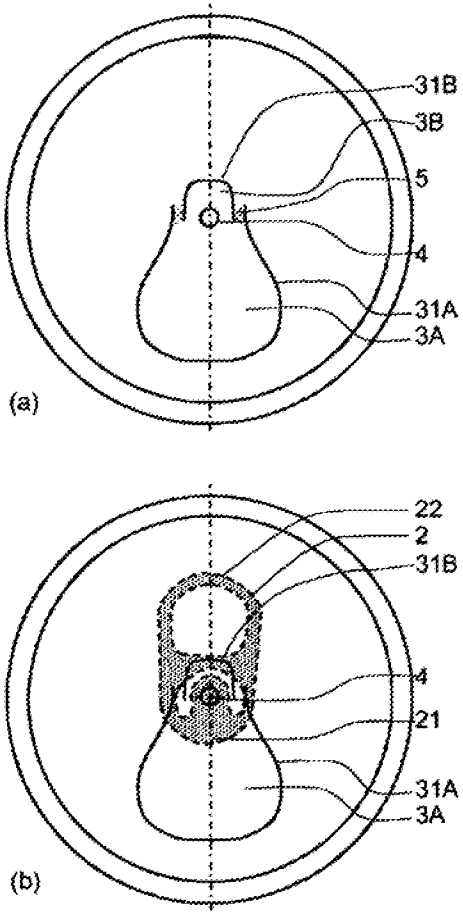
FIG. 2: shows a top view of the can top of a can according to a second embodiment of the present invention, represented (a) without and (b) with a pull tab.

In a second embodiment, illustrated in FIG. 2, the second score line (31B) is partially nested within the first score line (31A) on either side of the rivet (4). A section comprising the ends of the first and second score lines (31A, 31B) in the nesting areas overlap and run substantially parallel to one another. The stripes defined by the overlapping sections of the two score lines (31A, 31B) on either side of the rivet (4) form two torsion stripes (5). Like in the first embodiment, the lifting of the actuating end (22) of the pull tab tilts the rivet (4) towards the dispense area which is pressed by the puncturing end (21) of the tab until the first score line breaks to open the dispense aperture (13A). The tilting of the rivet is facilitated by the two torsion stripes (5) on either side thereof, thus increasing the stress on the metal of the vent area (3B) until the second score line (31B) breaks too, thus opening the vent aperture (13B).

Figure 3:
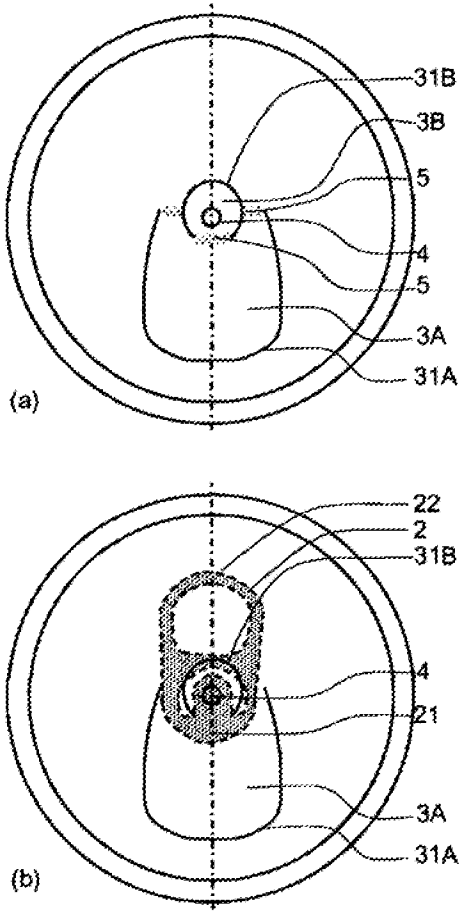
FIG. 3: shows a top view of the can top of a can according to a third embodiment of the present invention, represented (a) without and (b) with a pull tab.

A third embodiment, illustrated in FIG. 3 is quite similar to the second embodiment discussed supra, with the difference that the second score line circumscribes partly the rivet (4). In case the second score line (31B) forms a closed loop with a shallow score section, then the rivet may be fully circumscribed within the second score line. The open or shallow portion of the score line faces towards the dispense area (3A). Upon lifting the actuating end (22) of the pull tab, the rivet is tilted and forces the vent area open by breaking the second score line (31B). Both second and third embodiments are represented with a pull tab in transparency in FIGS. 2(*b*) and 3(*b*), respectively. Like the first embodiment, such cans look very much like traditional single aperture cans and can thus smoothly replace the latter without troubling the habits of the consumers.

In order to further facilitate the opening of the vent aperture (13B), the second score line (31B) defining the vent area (3B) may be deeper than the score line (31A) defining the dispense area (3A). This way, less force is required to break the second score line (31B), and since the vent area (3B) is generally substantially smaller than the dispense area (3A), the force applied by the pressurized gas inside the can to the second score line is lower than the one applied on the dispense area, thus reducing the risk of accidental blowing of the vent area.

Figure 4:
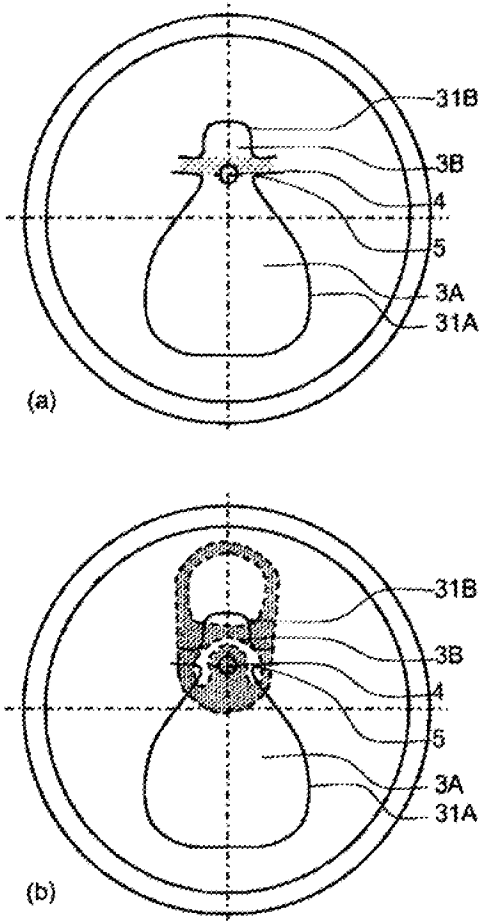
FIG. 4 shows a top view of the can top of a can according to a fourth embodiment of the present invention, represented (a) without and (b) with a pull tab.

In a preferred embodiment represented in FIG. 4, the rivet (4) is offset from the centre of the top end in the direction of the vent area (3B). This embodiment can be implemented with any score lines design according to the present invention such as the ones illustrated in FIGS. 1 to 3, and is particularly suitable for embodiments wherein the dispense area (3A), the rivet (4), and the vent area (31) are aligned on a diameter of the can top end. The advantage of the present embodiment is twofold. First, the dispense area can be larger, since the distance from the can top rim to the rivet is larger than the radius of the can top end. A larger dispense aperture permits a higher flow rate to be obtained, which can be desirable in some applications. The second advantage of the present embodiment is that the vent aperture (13B) is shifted closer to the rim than when the rivet is at the centre of the can top end. This is advantageous because it reduces the risk of liquid spilling out of the vent as the can is being tilted to pour the content thereof.

The present invention allows the provision of a vent aperture (13B) which combined opening with the dispense aperture (13A) can be triggered by the same single move as has been used by generations of consumers with traditional single aperture cans. Contrary to the solution proposed in CA2280461, the force required to open both openings is not much different from the one required to open traditional single aperture cans, because the geometry of the opening system of the present invention allows for a substantial leverage effect. For example, it is possible to open both apertures of a can according to the present invention in a single move with one hand only.

A can according to the present invention is particularly suitable for containing beverages. For example, alcoholic or non-alcoholic beer or other fermented beverages, such as cider, low malt content beer like beverages, sparkling wine, and the like, soda, tonic, juice, energetic beverages, pre-mixed long drinks of a spirit and a soda, milk, condensed milk, soup, sauce, and the like. The can may be made of aluminium, an aluminium alloy or tin plated steel.

What is claimed is:

1. A can for containing a liquid and comprising a top end, said top end comprising:

(a) a dispense area defined on said top end by a first score line;

(b) a pull tab coupled to the top end by a rivet, said pull tab comprising a puncturing end suitable for breaking the first score line and pushing into the interior of the can, without detaching the dispense area, to open a dispense aperture upon lifting an opposite actuating end of said pull tab away from the top end; and (c) a vent area defined on said top end by a second score line separate from the first score line and generally positioned on the opposite side of the rivet to the first dispense area;

wherein the first and second score lines are separated from one another by at least first and second torsion stripes of the can top material suitable for acting as hinges by torsion upon lifting the actuating end of the pull tab away from the can top, such that as the dispense aperture is opened by pushing the dispense area into the interior of the can, a vent aperture is opened by pulling the vent area outwards from the can top end;

wherein the rivet is disposed at the center of the top end of the can.

2. The can according to claim 1, wherein at least one of the first and second torsion stripes separating the first and second score lines is either devoid of any score line, or comprises secondary score lines much shallower than the first and second score lines suitable for promoting the bending of the respective torsion stripe upon lifting the actuating end of the pull tab, the secondary score lines being preferably discontinuous.

3. The can according to claim 1 wherein the rivet is partially circumscribed within the second score line defining the vent area.

4. The can according to claim 1 wherein the second score line defining the vent area is deeper than the first score line defining the dispense area.

5. The can according to claim 1, wherein the vent area is generally circular.

6. The can according to claim 1, wherein the dispense area has a major dimension in a direction about which the dispense area and vent area are arranged.

7. The can according to claim 1, wherein the second score line comprises first and second ends.

8. The can according to claim 7, wherein a third torsion stripe extends between the first and second ends of the second score line.

9. The can according to claim 8, wherein the rivet is circumscribed within the second score line and the third torsion stripe.

10. The can according to claim 7, wherein the first and second ends of the second score line are at least partially received within the dispense area defined by the first score line.

11. The can according to claim 8, wherein the third torsion stripe is received within the dispense area defined by the first score line.

12. The can according to claim 11, wherein the vent area is hingeably connected to the dispense area by the third torsion line.

13. The can according to claim 1, wherein the combination of the dispense area and the vent area define only a portion of an area defined by the whole the top end of the can.

14. A can for containing a liquid and comprising a top end, said top end comprising:

(a) a dispense area defined on said top end by a first score line;

(b) a pull tab coupled to the top end by a rivet, said pull tab comprising a puncturing end suitable for breaking the first score line and pushing into the interior of the can, without detaching the dispense area, to open a dispense aperture upon lifting an opposite actuating end of said pull tab away from the top end; and (c) a vent area defined on said top end by a second score line separate from the first score line and generally positioned on the opposite side of the rivet to the first dispense area;

wherein the first and second score lines are separated from one another by at least two torsion stripes of the can top material suitable for acting as hinges by torsion upon lifting the actuating end of the pull tab away from the can top, such that as the dispense aperture is opened by pushing the dispense area into the interior of the can, a vent aperture is simultaneously opened by pulling the vent area outwards from the can top end; and wherein the rivet is disposed at the centre of the top end of the can.

15. A can for containing a liquid and comprising a top end, said top end comprising:

(a) a dispense area defined on said top end by a first score line;

(b) a pull tab coupled to the top end by a rivet, said pull tab comprising a puncturing end suitable for breaking the first score line and pushing into the interior of the can, without detaching the dispense area, to open a dispense aperture upon lifting an opposite actuating end of said pull tab away from the top end; and (c) a vent area defined on said top end by a second score line separate from the first score line and generally positioned on the opposite side of the rivet to the first dispense area, the second score line comprising first and second ends;

wherein the first and second score lines are separated from one another by at least two torsion stripes of the can top material suitable for acting as hinges by torsion upon lifting the actuating end of the pull tab away from the can top, such that as the dispense aperture is opened by pushing the dispense area into the interior of the can, a vent aperture is opened by pulling the vent area outwards from the can top end;

wherein an additional torsion stripe extends between the first and second ends of the second score line; and wherein the rivet is circumscribed within the second score line and the additional torsion stripe.

* * * * *